US008317162B2

(12) United States Patent
Welandson

(10) Patent No.: US 8,317,162 B2
(45) Date of Patent: Nov. 27, 2012

(54) ROAD RAIL

(75) Inventor: Anders Welandson, Smålandsstenar (SE)

(73) Assignee: AB Varmforzinkning, Smalandsstenar (SE)

( * ) Notice: Subject to any disclaimer, the term of this patent is extended or adjusted under 35 U.S.C. 154(b) by 19 days.

(21) Appl. No.: 12/994,524

(22) PCT Filed: May 20, 2009

(86) PCT No.: PCT/SE2009/050576

§ 371 (c)(1),
(2), (4) Date: Feb. 22, 2011

(87) PCT Pub. No.: WO2009/145707

PCT Pub. Date: Dec. 3, 2009

(65) Prior Publication Data

US 2011/0155981 A1 Jun. 30, 2011

(30) Foreign Application Priority Data

May 30, 2008 (SE) ..... 0801271

(51) Int. Cl.
*E01F 15/04* (2006.01)

(52) U.S. Cl. ..... 256/13.1; 256/65.02

(58) Field of Classification Search ..... 256/13.1, 256/65.02, 65.03, 65.07
See application file for complete search history.

(56) References Cited

U.S. PATENT DOCUMENTS

| | | | | |
|---|---|---|---|---|
| 3,428,299 | A | 2/1969 | Mogensen | |
| 3,476,362 | A * | 11/1969 | Thompson | 256/13.1 |
| 3,491,984 | A * | 1/1970 | Nyberg | 256/21 |
| 3,591,144 | A * | 7/1971 | Iving | 404/6 |
| 3,704,861 | A * | 12/1972 | Glaesener | 256/13.1 |
| 4,334,671 | A * | 6/1982 | De Guise | 256/65.12 |
| 4,390,164 | A * | 6/1983 | Cokelekoglu | 256/65.13 |
| 4,451,025 | A * | 5/1984 | Spera | 256/65.12 |
| 4,805,879 | A * | 2/1989 | Spera | 256/65.12 |
| 5,391,016 | A * | 2/1995 | Ivey et al. | 404/6 |
| 7,438,284 | B2 * | 10/2008 | McGinness et al. | 256/59 |

FOREIGN PATENT DOCUMENTS

| | | |
|---|---|---|
| EP | 1 612 334 | 1/2006 |
| JP | 2011214313 A * | 10/2011 |
| WO | WO 98/42918 | 10/1998 |

* cited by examiner

*Primary Examiner* — Joshua Kennedy
(74) *Attorney, Agent, or Firm* — Merchant & Gould P.C.

(57) ABSTRACT

A road rail comprises tubular posts (1; 20) to be anchored in the ground and a rail profile (2; 21) to be attached to the posts. The rail profile has a substantially closed cross-section but is open downwards for lowering onto the posts. The rail profile is supported on each post by a support member (5; 24) carried by lower edges of opposed cutouts (4; 23) in the post. At least one locking member (7; 26) inside the rail profile provides locking between the post and the rail profile by engagement on one hand with the rail profile and on the other hand with an upper edge of each post cutout (4; 23) by a locking tongue (10; 27) of the locking member.

10 Claims, 3 Drawing Sheets

ROAD RAIL

This application is a National Stage Application of PCT/SE2009/050576, filed 20 May 2009, which claims benefit of Serial No. 0801271-8, filed 30 May 2008 in Sweden and which applications are incorporated herein by reference. To the extent appropriate, a claim of priority is made to each of the above disclosed applications.

TECHNICAL FIELD

The present invention relates to a road rail, comprising tubular posts to be anchored in the ground and a rail profile to be attached to the posts, the rail profile having a substantially closed cross-section but being open downwards for lowering onto the posts.

BACKGROUND OF THE INVENTION

Road rails of the above type may primarily be used between two lanes of a road for preventing such accidents as collisions between vehicles. Another use is at the side of a road for preventing vehicles to accidentally leave the road.

The cross-sectional shape of the rail profile is of importance to the effect of rail, where it is of importance that the rail shall be able to withstand forces in a controlled way, at the same time as impact damages to the vehicles and their occupants shall be minimized. It has appeared that a rail profile with a generally elliptical cross-sectional shape is advantageous.

In a previous design the rail profile is mounted to the posts by a system comprising internal and external attachments and screw joints.

The main purpose of the invention is to provide a mounting system without screw joints or the like. It shall be possible to quickly and easily mount the rail profile to the posts without use of tools and also to dismount the rail profile, for example at the repair after an occurred accident.

SUMMARY

This is according to the invention attained by a mounting system generally comprising a support member carried by lower edges of opposed cutouts in each post and supporting the rail profile and at least one locking member inside the rail profile, the locking member providing locking between the post and the rail profile by engagement on one hand with the rail profile and on the other hand with an upper edge of each post cutout by a locking tongue of the locking member.

The support member preferably has a shape corresponding to the shape of the rail profile for providing good support over its entire length.

For increasing its stability and strength, the support member may be provided with at least one perpendicular flange.

In a first embodiment of the invention the locking member has the general shape of a U-profile, whose sidewalls at a larger distance from each other than the outer diameter of the posts are each provided with the locking tongue and has a geometry for holding the rail profile against the support member with its lower edge.

For increasing the stability of the design, the support member flange may be provided with indentations, into which the locking tongues extend.

The locking member may have openings for engagement by a crowbar or the like at a dismounting of the rail from the posts.

In a second embodiment a locking member is arranged at each side of the post inside the rail profile and has a geometry for holding the rail profile against the support member with its lower portion.

For increasing the engagement between the rail profile and the post, an upper portion of the post may be provided with a notches, each for engagement with an upper portion of each locking member.

For increasing the stability of the design, the support member flange may be provided with indentations, into which the locking tongues extend.

In both embodiments the lower and upper edges of the cutouts are prefereably beveled in order to accommodate for deviations from the perpendicular relative position between the posts and the rail profile.

BRIEF DESCRIPTION OF THE DRAWINGS

The invention will be described in further detail below under reference to the accompanying drawings, in which.

DETAILED DESCRIPTION

In this specification such words as "upper", "lower", "upright" and "vertical" refer to positions and directions when a road rail according to the invention is erected on or at a road and are not intended to be limiting in any way.

Figure 1:
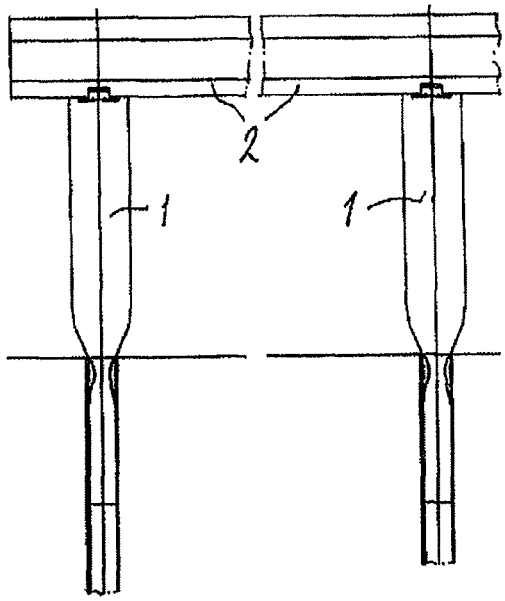
FIG. 1 is a side view of a road rail according to the invention.
Figure 2:
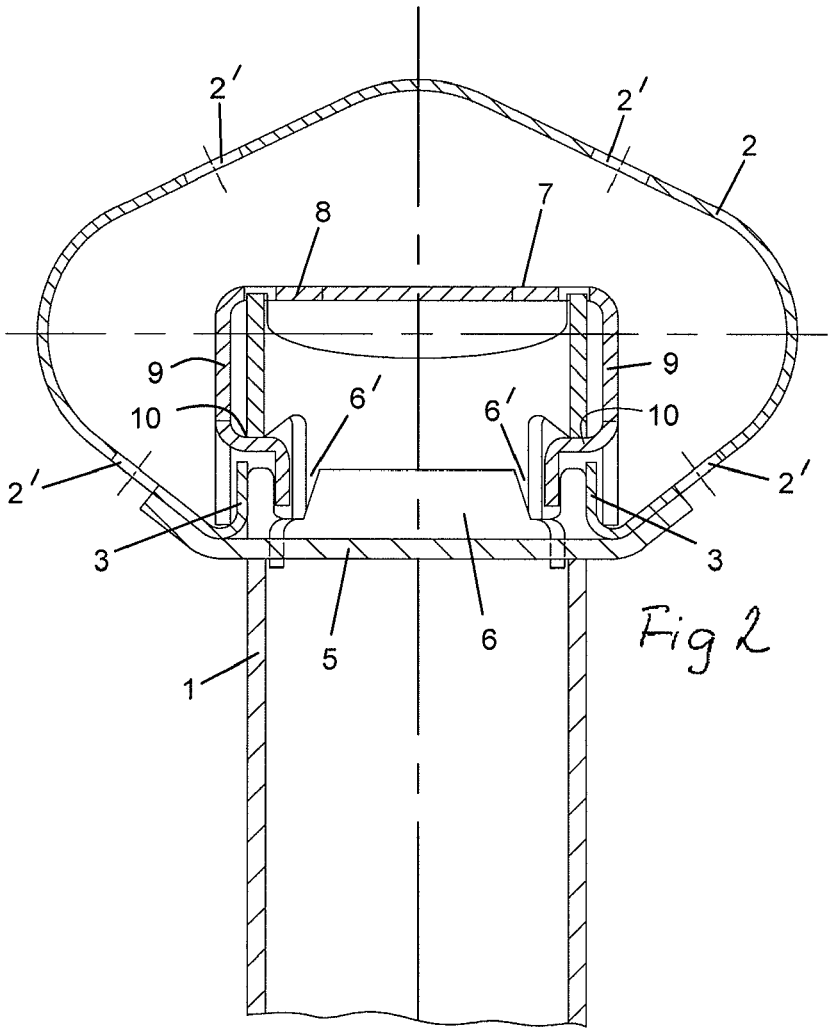
FIG. 2 is a section through a road rail according to a first embodiment of the invention.
Figure 3:
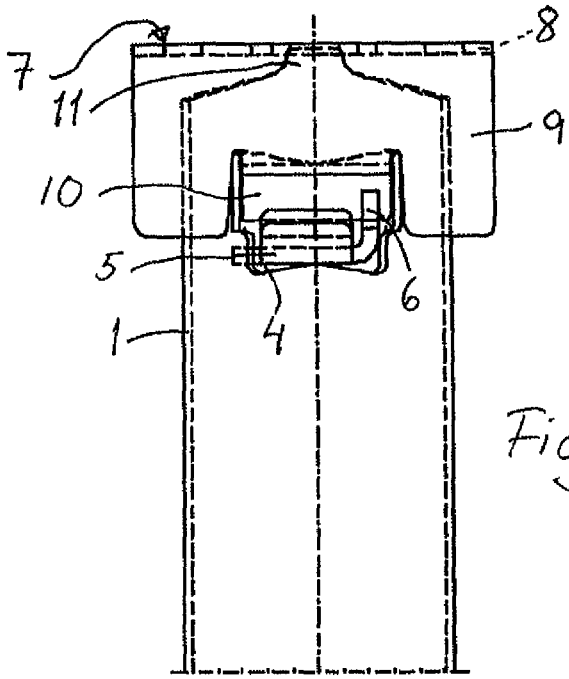
FIG. 3 is a side elevation view of to FIG. 1 of the same road rail but without a rail profile.
Figure 4:
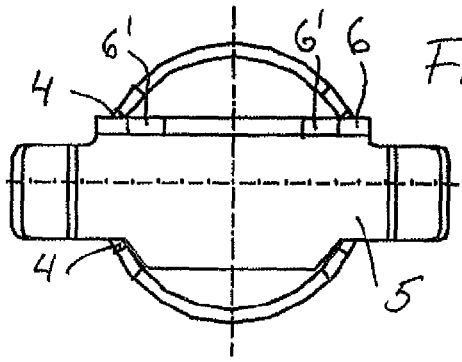
FIG. 4 is a top view of the road rail shown in FIG. 3 but with a locking member removed, FIG. 5 corresponds to FIG. 4 but with the locking member again added.
Figure 5:
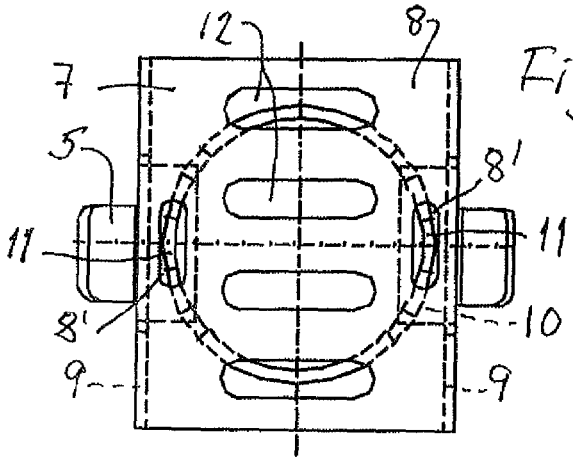

A road rail according to the invention is shown in a side view in FIG. 1. Such a road rail is normally placed between two meeting lanes of a road for preventing collisions between vehicles but may of course also be placed at the roadside for protecting vehicles from leaving the road.

This road rail comprises basically tubular posts 1 anchored at intervals to the ground and a rail profile 2 attached to the posts 1 in a way to be described.

A first embodiment of a road rail according to the invention is shown in FIGS. 2-5. The rail profile 2, which is removed in FIGS. 3-5 for the sake of clarity, has a shape suitable for absorbing collision energy from a vehicle. The rail profile 2 has a longitudinal lower opening with a slightly larger width than the outer diameter of the posts 1. Upright profile flanges 3 are provided at the lower opening. Towards each of its ends the rail profile 2 may be provided with holes 2' for the attachment of joint members between neighboring profiles.

Each post 1 has towards its upper end diametrically opposed cutouts 4 for receiving a support member 5. This support member 5 preferably may have a suitable shape for providing adequate support for the rail profile 2. In the case shown in FIG. 2 the support member 5 accordingly is cradle-shaped. At mounting the support member 5 is introduced through the post cutouts 4 and will rest on their bottoms or lower edges, which have the shown bevel-shape in order to accommodate for possible deviations from the perpendicular relative position between the post 1 and the rail profile 2. Hereafter the rail profile 2 is lowered down over the top of the post 1 and comes to rest with its lower portion on the support member 5.

In order to enhance the strength and stability of the support member 5 it may be provided with a perpendicular flange 6. The flange may be provided with two indentations 6' for a purpose to be described.

A locking member 7 is used to lock the rail profile 2 to the post 1. This locking member 7 may generally have the appearance of a U-profile with a rectangular portion 8, which is generally horizontal in mounted condition, and two downwardly extending sidewalls 9 at a somewhat greater distance from each other than the diameter of the post 1. Each sidewall 9 is provided with a double-bent locking tongue 10.

A horizontal portion of each locking tongue 10 is intended to lockingly cooperate with the upper edge of the corresponding cutout 4, at the same time as the lower end of the sidewall 9 clamps the rail profile 2 against the support member 5. The upper edge of the cutout 4 is beveled for the same reason as its bottom.

A further security against unintentional release is provided by engagement of the vertical portion of each locking tongue 10 with the indentation 6' of the support member flange 6.

The U-shaped locking member 7 is applied with a certain force sideways in the longitudinal direction of the rail profile 2.

An extra locking effect may be provided by vertical extensions 11 at the upper end of the post 1; these extensions are received by rectangular holes 8' in the rectangular portion 8. Alternatively, the locking member may be provided with end lugs, which can be bent down after mounting at either side of the post 1.

The rectangular portion 8 may be provided with openings 12 for engagement by a tool such as a crowbar useable at a later demounting of the locking member 7.

Figure 6:
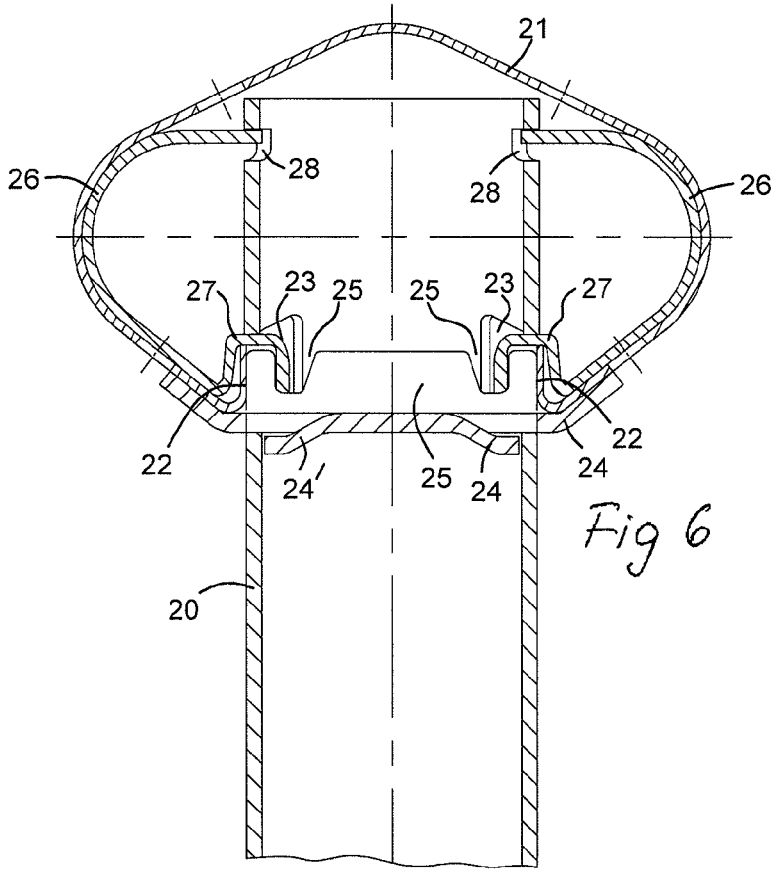
FIG. 6 is a section through a road rail according to a second embodiment of the invention.
Figure 7:
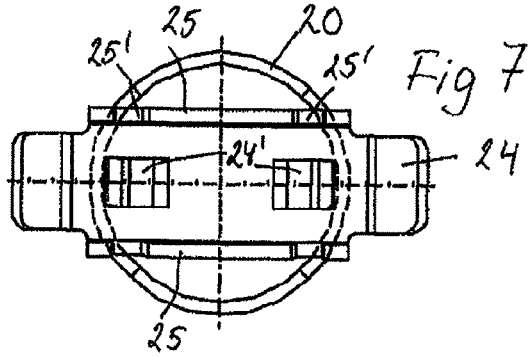
FIG. 7 is a top view of the road rail shown in FIG. 6 but without a rail profile and a locking member, and FIG. 8 corresponds to FIG. 7 but with the locking member again added.
Figure 8:
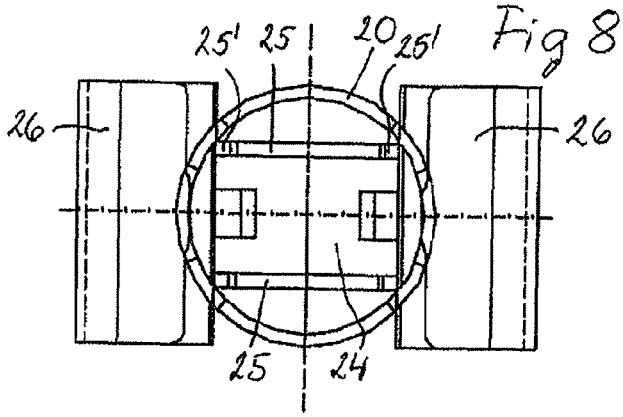

A second embodiment of a road rail according to the invention is shown in FIGS. 6-8. The second embodiment differs from the first embodiment mainly in the locking of the rail profile to the post, and accordingly reference in other respects is made to the description above of the first embodiment.

In FIGS. 6-8 the following members may thus be found: a post 20, a rail profile 21 with profile flanges 22, cutouts 23, a support member 24, and a perpendicular flange 25 with two indentations 25'.

In this embodiment the support member 24 may be provided with stop tongues 24' cooperating with the post 20 and thus preventing the support member 24 from lateral movements. Also, the support member 24 may be provided with two flanges 25.

In the first embodiment use is made of one locking member 7 with two locking tongues 10, whereas in the second embodiment use is made of two locking members 26, one at each side of the post 20.

Each such locking member 26 is shaped to fit into and cooperate with the rail profile 21 and has a certain length in the longitudinal direction of the rail profile 21. At its lower end it has a locking tongue 27 lockingly cooperating with the cutout 23 in the post 20. In order to secure its longitudinal position in relation to the post 21 the locking member 26 may at its upper end engage a notch 28 in the post 21, as is especially visible in FIG. 6.

Two embodiments of the invention have been shown and described, but it is obvious for the person skilled in the art that other embodiments are possible within the scope of the appended claims and also that modifications of these two embodiments are possible.

The invention claimed is:

1. A road rail, comprising tubular posts to be anchored in the ground and having opposed cutouts in each post, each cutout having upper and lower edges; a rail profile to be attached to the posts, the rail profile having a substantially closed cross-section having a downwardly facing opening for lowering the profile onto the posts, a support member carried by the lower edges of the opposed cutouts in each post and supporting the rail profile thereon; and at least one locking member located inside the rail profile and having locking tongues, the locking member providing locking between the post and the rail profile by engagement with the rail profile against the support member and also with an upper edge of each post cutout by a respective locking tongue.

2. A road rail according to claim 1, wherein the support member has a shape corresponding to the shape of the rail profile.

3. A road rail according to claim 1, wherein the support member is provided with at least one perpendicular flange.

4. A road rail according to claim 3, wherein the support member flange is provided with indentations, into which the locking tongues extend.

5. A road rail according to claim 3, wherein the support member flanges are provided with indentations, into which the locking tongues extend.

6. A road rail according to claim 1, wherein the locking member has a shape of a U-profile, whose sidewalls at a larger distance from each other than an outer diameter of the posts are each provided with the locking tongue and has a geometry for holding the rail profile against the support member with the lower edge.

7. A road rail according to claim 6, wherein the locking member has openings for engagement by a crowbar.

8. A road rail according to claim 1, wherein a locking member is arranged at each side of the post inside the rail profile and has a geometry for holding the rail profile against the support member with a lower portion of the rail profile.

9. A road rail according to claim 8, wherein an upper portion of the post is provided with a notch for engagement with an upper portion of the locking member.

10. A road rail according to claim 1, wherein the lower and upper edges of the cutouts are beveled in order to accommodate for deviations from a perpendicular relative position between the posts and the rail profile.

* * * * *